United States Patent [19]

Gallagher et al.

[11] 4,261,823

[45] Apr. 14, 1981

[54] STORM DRAIN CATCH BASIN

[75] Inventors: Thomas H. Gallagher, Reno; James G. Bastian, Carson City, both of Nev.

[73] Assignee: Summit Engineering Corporation, Reno, Nev.

[21] Appl. No.: 62,156

[22] Filed: Jul. 26, 1979

[51] Int. Cl.[3] ..... E03F 1/00

[52] U.S. Cl. ..... 210/164

[58] Field of Search ..... 210/163, 164, 165, 170, 210/311, 532, 536; 404/2, 4, 5, 25

[56] References Cited

U.S. PATENT DOCUMENTS

| | | | |
|---|---|---|---|
| Re. 29,996 | 5/1979 | Jordan | 210/311 |
| 325,231 | 9/1885 | Badgley | 404/4 |
| 543,617 | 7/1895 | Dunstan | 210/164 |
| 1,108,852 | 8/1914 | Scheuermann | 210/460 |
| 1,579,205 | 4/1926 | Blakesley et al. | 210/311 |
| 1,654,803 | 1/1928 | Griffith | 404/4 |
| 1,664,853 | 4/1928 | Frith | 404/5 |
| 2,263,259 | 11/1941 | Boosey | 210/164 |
| 2,348,651 | 5/1944 | Schelly | 210/311 |
| 2,634,862 | 4/1953 | Smith | 210/311 X |
| 3,038,396 | 6/1962 | Jameson, Jr. | 404/2 |
| 3,862,039 | 1/1975 | Summers | 210/170 |
| 4,031,009 | 6/1977 | Hicks | 210/170 |
| 4,165,285 | 8/1979 | Weber | 210/311 |

*Primary Examiner*—Theodore A. Granger

*Attorney, Agent, or Firm*—Clarence A. O'Brien; Harvey B. Jacobson

[57] ABSTRACT

The basin includes a standpipe having axially extending slots spaced vertically from its bottom. A baffle extends coaxially within the pipe around the slots to separate oil and grease from the runoff. The accumulated water is held in the standpipe thereby allowing the larger particles to settle out into the lower portion of the standpipe before the water flows through the slots into an outer chamber. The outer chamber contains a cylindrical filter element through which the water must flow. The filter element removes suspended lighter solids and any remaining grease or oil not removed in the standpipe. The cleansed runoff finally is discharged through an outflow pipe extending from the outer chamber. The standpipe can be periodically cleansed by removal of a drop inlet grate which covers the pipe. Furthermore, the filter element can be removed for cleaning.

13 Claims, 5 Drawing Figures

STORM DRAIN CATCH BASIN

BACKGROUND OF THE INVENTION

1. Field of the Invention

This invention relates to drainage systems and especially to improvements in catch basins designed to receive surface water runoff and to serve as an initial separation stage for removing contaminants from the runoff.

2. Discussion of Related Art

Catch basins are conventionally used in building areas, roadways, parking lots, etc. where the soil surface has been sealed thereby preventing absorption of water runoff into the soil. The catch basin functions to separate the runoff from matter carried therewith which would ordinarily not readily pass through the sewer to which the catch basin discharge is connected. Various types of catch basins have been suggested for providing this filtering effect. For instance, U.S. Pat. No. 3,038,396, issued June 12, 1962, to Jameson, Jr. et al, discloses a structure for providing liquid drainage directly downward and the upward venting of gas. The Jameson structure includes a relatively large perforated pipe which is supported by a smaller perforated pipe in a hole drilled in the earth and filled with a relatively coarse filtering material within the larger breather pipe and an outer casing of finer filtering material whereby gas can flow upward and be discharged through the coarser filter material and the water can flow by gravity and capillarity downwardly through the surrounding casing of fine filtering material. U.S. Pat. No. 1,108,852, issued Aug. 25, 1914, to Scheuermann, shows a drainage plant for road beds which provides a series of hollow spaces which may be opened and in which the street waters run to the sides, and ooze away in a clarified condition after the solid particles have settled in removable settling boxes. U.S. Pat. No. 1,654,803, issued Jan. 3, 1928, to Griffith, shows a sanitary catch basin wherein the sewer connection is located at a comparatively low level while the outflow from the catch basin may be arranged at a much higher level in order to increase the sediment capacity of the catch basin. U.S. Pat. No. 4,031,009, issued June 21, 1977, to Hicks shows a precast reinforced concrete catch basin including a solid horizontal bottom wall with solid, hollow, cylindrical side walls upstanding therefrom to form a sealed, unapertured, undrained sump receptacle for collecting drain water. The hollow, cylindrical upper half contains leaching openings which extend through from the inside to the outside for discharging cleared water.

SUMMARY OF THE INVENTION

One object of the present invention is to provide a storm drain catch basin which can effectively remove large particles entrained in liquid runoff by allowing such particles to settle out of the runoff.

Another object of the present invention is to provide a storm drain catch basin which can entrap oil, grease or other floating pollutants thereby removing these from the runoff.

A further object of the present invention is to provide a storm drain catch basin which includes both primary and secondary separation stages to insure adequate cleaning of runoff prior to channeling the runoff through a discharge to a sewer system.

A still further object of the present invention is to provide a storm drain catch basin wherein the separated materials can easily be removed from the catch basin.

In accordance with the above objects, the present invention includes a central standpipe having an enclosed bottom for retaining fluid therein. Spaced above the bottom of the standpipe are a plurality of axially extending slots spaced circumferentially of the standpipe. Connected to the standpipe and disposed coaxially within it spaced radially inward from the slots is a cylindrical baffle member. Over the top of the standpipe a drop inlet grate is disposed for receiving the water runoff. The runoff enters the standpipe and fills the bottom thereof. Grease, oil and other floating pollutants are trapped by the baffle while the larger particles settle out into the bottom of the standpipe. The water runoff passes through the slots into a second chamber. The second chamber has an upstanding solid annular wall upon which sets a filter element. The runoff passes through the filter element to a discharge chamber which is connected to the outlet pipe extending to the sewer. The filter element removes the finer particles of debris and any oil, grease or other floating pollutants which are not entrapped in the standpipe. These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
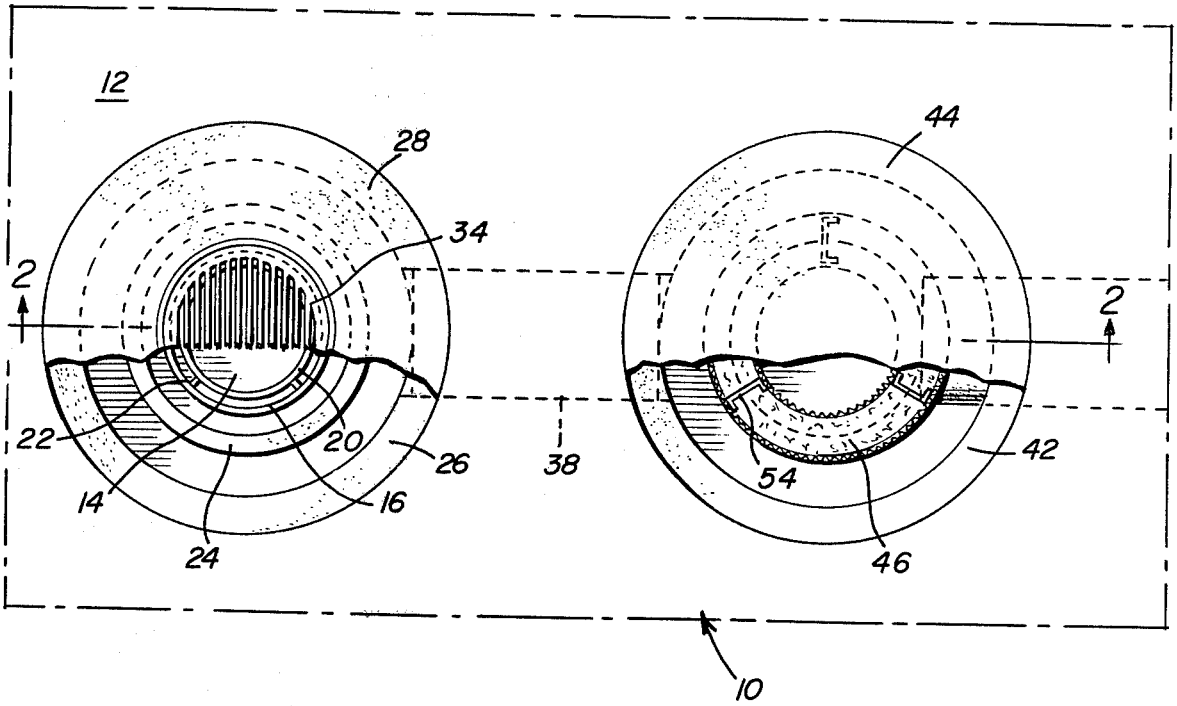
FIG. 1 is a top plan fragmental view of the storm drain catch basin.

Now with reference to the drawings, a storm drain catch basin incorporating the principles and concepts of the present invention and generally referred to by the reference 10 will be described in detail. The catch basin 10 is installed in the ground below the level of the surface covering 12 which can be asphalt or the like. The surface covering should be provided with an adequate slope to insure the collection of runoff in the storm drain catch basin. A first base 14 is produced from concrete and poured into place. Base 14 supports standpipe 16 and serves to close off the lower end of that standpipe. The standpipe is, preferably, a 24-inch steel pipe and is provided with a plurality of slots 18 each of which extends axially of the pipe and is spaced adequately above the base 14 to allow water to accumulate in the lower portion of the pipe. The slots are are, preferably, $\frac{1}{4}$ inch $\times$16 inches and are spaced at one-inch intervals circumferentially about the standpipe 16. Of course, the dimensions can be varied as desired. A $\frac{1}{4}$-inch plate baffle 20 is mounted coaxially within the standpipe and extends from a position below the slots 18 to a position above the slots 18. The baffle serves to entrap oil, grease and other floating pollutants within the standpipe while the clear runoff flows through the slots. The baffle can be welded as shown at 22 or attached to the standpipe in any convenient manner.

Figure 5:
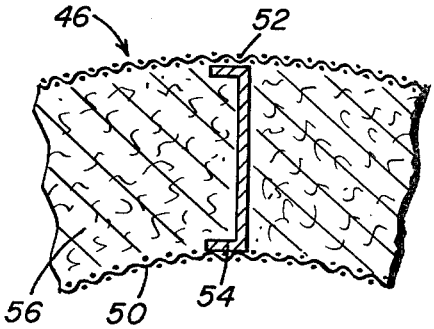
FIG. 5 is a detailed fragmental view showing the construction of the filter element used in the present invention.
Figure 2:
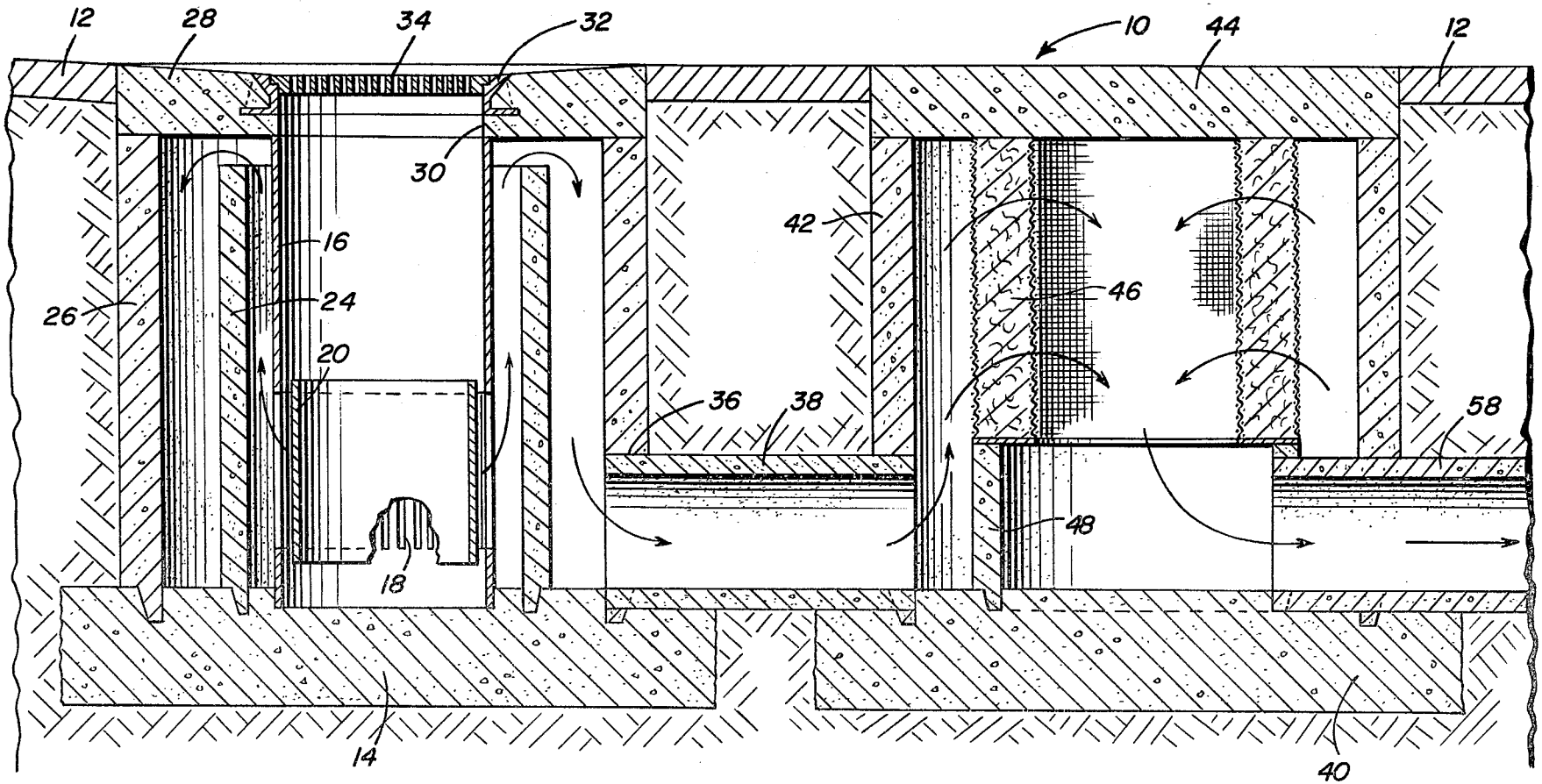
FIG. 2 is a side elevational sectional view taken substantially along a plane passing through section line 2—2 of FIG. 1.

A 30-inch reinforced concrete pipe 24 rests upon base 14 and coaxially surrounds standpipe 16. The top of pipe 24 is spaced below the top of standpipe 16 and above slots 18. Pipe 24 serves to define the level of water accumulation necessary in the standpipe before the water is allowed to exit. The water flows over pipe 24 into an annular chamber defined by pipe 24 and a 48-inch reinforced concrete pipe 26. Pipe 26 is also mounted in base 14 and serves to support precast concrete cover 28 which rests thereon and is solid except for an opening 30 which aligns with the standpipe 16. A drop inlet frame 32 is contained within the cover 28 and receives drop inlet grate 34 removably therein. Storm waters enter through the grate which removes the largest elements of debris. The water flows out through the slots 18 with grease remaining in the standpipe. The water rises to the top of pipe 24 and flows thereover. An opening 36 is contained in the outer wall 26 and receives connector pipe 38 which is also a precast reinforced concrete pipe section. The water then enters the filter element stage which includes a base 40 supporting an outer wall in the form of reinforced concrete pipe section 42 which, like pipe 26, is preferably 48 inches in diameter. Pipe 42 supports cover 44 which covers the top of filter element 46. The filter element rests on a further reinforced concrete section 48 which, like pipe section 24, is preferably 30 inches in diameter. As seen in FIG. 5, the filter element consists of a prefabricated inner cylindrical screen 50 and a prefabricated outer cylindrical screen 52 which are maintained in coaxial relationship by their connection to opposite ends of channel members 54 which are spaced about the filter member. Disposed between the inner and outer screens is the filter material 56, the size and type of which can vary according to the needs of the installation.

Obviously, as the runoff water flows over the top of pipe 24, it is channeled through connector pipe 38 into the confines of pipe 42 at which time it flows over wall 48 and through the filter element 46 entering into the center of the filter element. The water then flows through outlet pipe 58 which is also reinforced concrete pipe and, like connector pipe 38, is 12 inches in diameter. Outlet pipe 58 extends radially through the walls of pipes 48 and 42 and is connected with an existing sewer line.

Figure 3:
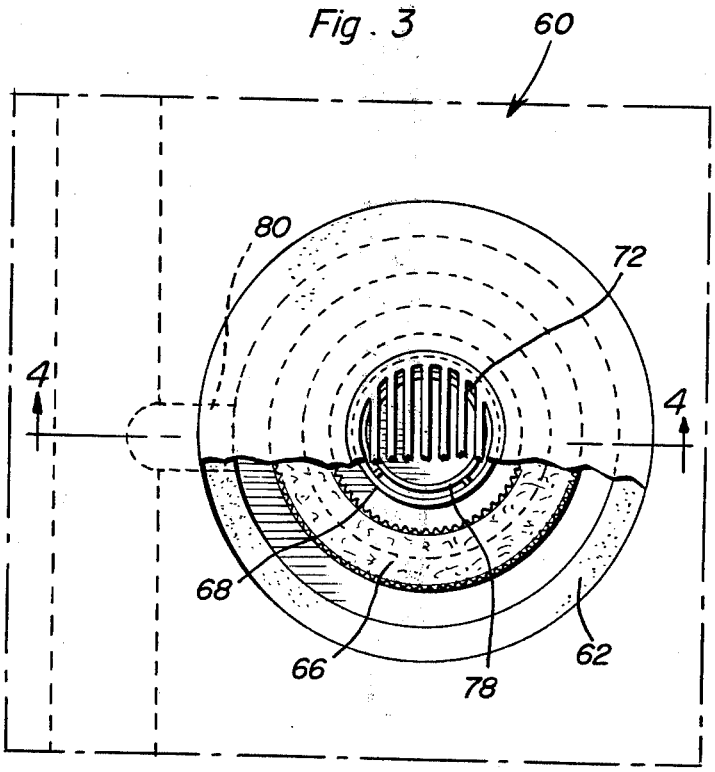
FIG. 3 is a top plan part fragmental view of a second embodiment of the storm drain catch basin.
Figure 4:
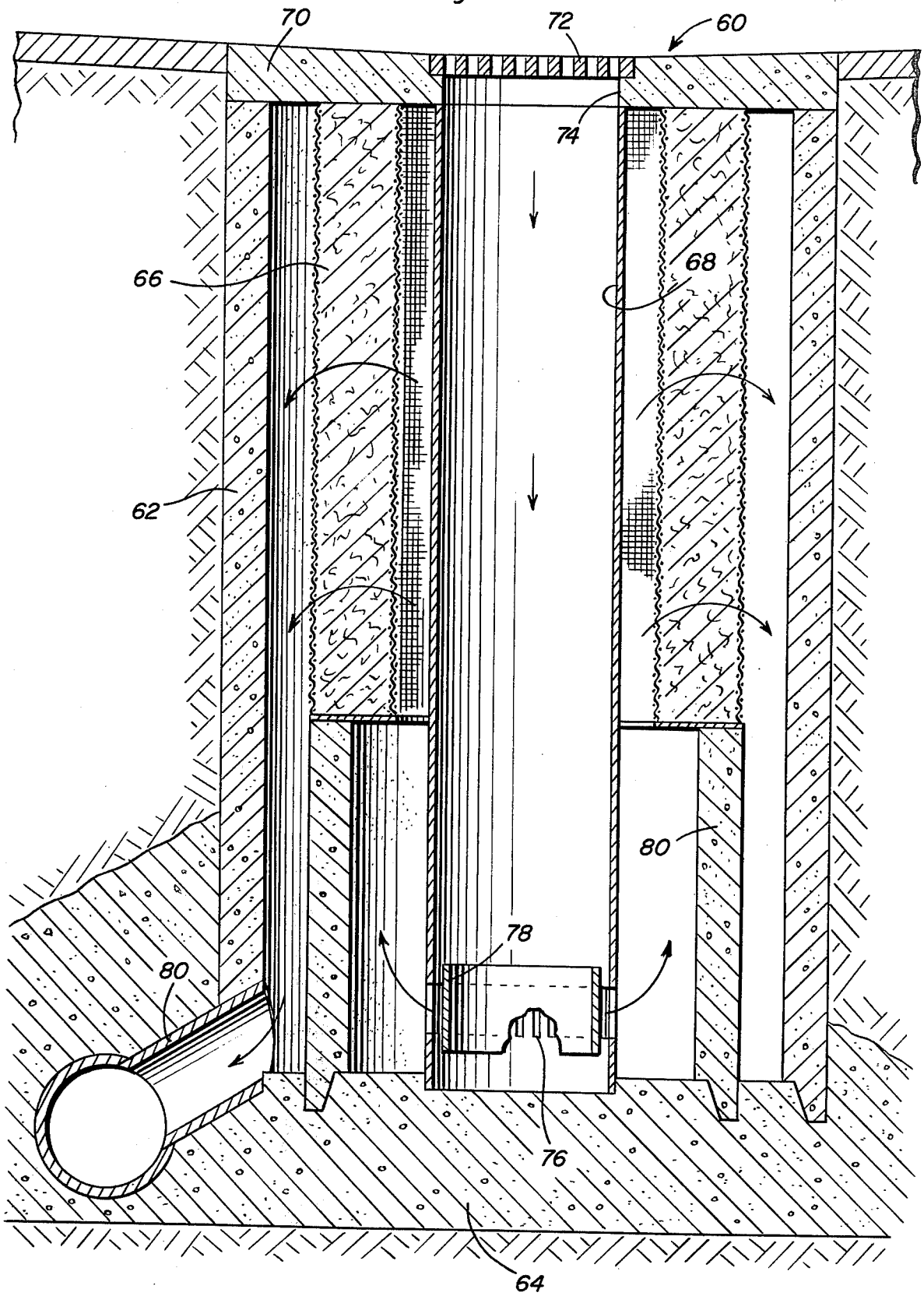
FIG. 4 is a side elevational sectional view taken substantially along a plane passing through section line 4—4 of FIG. 3.

A second embodiment of the storm drain catch basin is shown in FIGS. 3 and 4 and is generally known by the reference numeral 60. Storm drain catch basin 60 includes an outer reinforced concrete pipe section 62 which is mounted in base 64 which is poured in place in an opening provided for that purpose. A filter element 66 and standpipe 68 are coaxially mounted within the wall 62. A cover 70 is supported by wall 62 and covers both the filter element 66 and the standpipe 68. A drop inlet grate 72 is removably mounted in the cover 70 in a hole 74 which aligns with the top of the standpipe 68. As with the embodiment 10 of the invention, standpipe 68 includes a plurality of slots 76 which extend therethrough and are internally covered by coaxial baffle 78 which is mounted to the inside of the standpipe. An intermediate wall 80 is mounted on base 64, surrounds the lower portion of the standpipe and supports the filter element 66. Wall 80 is made from reinforced concrete and serves to define the height of water level which will be maintained in the standpipe. Obviously, as water is accumulated in the standpipe, the oil, grease and other floating debris will be entrapped with larger particles settling out in the bottom of the standpipe. The clean water will pass through slots 76 and accumulate until it reaches the height of wall 80 at which time it will pass through filter element 66 which is constructed in the same manner as filter element 36, which was discussed with reference to FIG. 5. The clean water which has passed through filter element 66 will enter outlet pipe 80 extending through pipe 62 and enters the sewer system to which the storm drain catch basin is connected.

By simply removing grates 34 or 72, the settled debris can be removed from the bottom of standpipes 60 or 68, respectively. If it is desired to clean the filter elements, the concrete covers 44 or 70 can be removed and the filter elements 46 and 66 can be removed for replacement or cleaning as desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A storm drain catch basin for receiving liquid runoff and separating impurities therefrom, said catch basin comprising:

a base;

a standpipe mounted on said base and having a runoff receiving end, a liquid discharge area, and an enclosed bottom space below said liquid discharge area, said enclosed bottom space being partially defined by said base;

a primary separation means disposed in said liquid discharge area for separating larger impurities from said runoff, said primary separation means including a plurality of apertures formed through said standpipe in said liquid discharge area, said apertures being sized so as to prevent impurities of a predetermined size from passing therethrough, and a baffle means spaced inwardly from said apertures in said standpipe for preventing floating impurities from passing through said apertures;

a liquid flow path defined from said liquid discharge area;

a secondary separation means disposed across said liquid flow path for separating additional impurities from said runoff, said secondary separation means including a cylindrical filter element for removing residual impurities from said runoff; and a baffle wall means disposed in said liquid flow path about the exterior of said standpipe and having an upper end spaced below said runoff receiving end for defining the height of standing liquid runoff maintained in said standpipe.

2. The storm drain catch basin defined in claim 1 and further including a grate removably disposed over said receiving end.

3. The storm drain catch basin of claim 1 wherein said baffle means comprises a cylindrical section mounted coaxially within said standpipe and extending from a position below said apertures to a position above said apertures.

4. The storm drain catch basin defined in claim 1 wherein said cylindrical filter element is disposed about said standpipe and rests on and is supported by said baffle wall means for removing residual impurities from said runoff.

5. The storm drain catch basin defined in claim 1 wherein said standpipe is disposed in a first ground opening and further wherein said secondary separation means is received in a second ground opening spaced laterally of said first ground opening.

6. The storm drain catch basin defined in claim 5 and further including a first cover disposed over said first ground opening and a second cover disposed over said second ground opening.

7. A storm drain catch basin disposed in the earth for receiving liquid ground runoff, comprising, in combination:

a first ground opening;

a standpipe disposed within said ground opening and having an open upper end for receiving said runoff, a closed lower end, and a plurality of discharge apertures formed therein and spaced above said lower end;

a baffle plate means mounted inside said standpipe and coaxially therewith and extending from a position below said apertures to a position above said apertures for inhibiting the discharge for floating impurities through said apertures;

a surrounding wall disposed in said ground opening and extending to a position above said apertures and below said open upper end for defining the height of standing liquid runoff to be maintained in said standpipe; and an outlet path leading away from said surrounding wall for removing liquid runoff.

8. The storm drain catch basin defined in claim 7 and further including a filter element disposed across said liquid flow path for removing residual impurities from said runoff.

9. The storm drain catch basin defined in claim 8 wherein said filter element is mounted on top of said surrounding wall and surrounds the exterior of said standpipe within said first ground opening.

10. The storm drain catch basin of claim 8 and further including a second ground opening, said filter element being disposed in said second ground opening in said liquid flow path.

11. The storm drain catch basin of claim 10 and including a support wall disposed in said second ground opening for supporting said filter element.

12. The storm drain catch basin of claim 11 wherein said liquid flow path includes an outlet pipe disposed through said supporting wall for removing liquid from said second ground opening.

13. The storm drain catch basin of claim 12 and further including a first cover means for covering said first ground opening and a second cover means for covering said second ground opening.

* * * * *